United States Patent [19]

Schwab

[11] Patent Number: 4,850,312

[45] Date of Patent: Jul. 25, 1989

[54] INTERNAL COMBUSTION ENGINE PROVIDED WITH IMPROVED CYLINDER BLOCK COOLING MEANS

[75] Inventor: Luc Schwab, Rueil Malmaison, France

[73] Assignees: Automobiles Peugeot, Paris; Automobiles Citroen, Neuilly/Seine, both of France

[21] Appl. No.: 141,615

[22] Filed: Jan. 7, 1988

[30] Foreign Application Priority Data

Jan. 9, 1987 [FR] France ..... 87 00174

[51] Int. Cl.[4] ..... F02F 1/14; F02F 7/00

[52] U.S. Cl. ..... 123/41.74; 123/41.79

[58] Field of Search ..... 123/41.72, 41.74, 41.79, 123/41.82 R

[56] References Cited

U.S. PATENT DOCUMENTS

| | | | |
|---|---|---|---|
| 3,385,273 | 5/1968 | Baster | 123/41.74 |
| 3,942,487 | 3/1976 | Zink | 123/41.79 |
| 4,106,444 | 8/1978 | Deutschmann | 123/41.82 R |
| 4,369,739 | 0/0000 | Umemura et al. | 123/41.74 |
| 4,470,376 | 9/1984 | Hayashi | 123/41.74 |
| 4,693,294 | 9/1987 | Albrecht et al. | 123/41.74 X |

FOREIGN PATENT DOCUMENTS

| | | | |
|---|---|---|---|
| 2143734 | 3/1973 | Fed. Rep. of Germany | 123/41.82 R |
| 2904167 | 8/1980 | Fed. Rep. of Germany | 123/41.82 R |
| 2257788 | 8/1975 | France . | |
| 61-53445(A) | 3/1986 | Japan . | |
| A-8000595 | 4/1980 | PCT Int'l Appl. . | |
| 809529 | 2/1959 | United Kingdom . | |

*Primary Examiner*—Tony M. Argenbright
*Assistant Examiner*—Carlberg Eric R.
*Attorney, Agent, or Firm*—Burns, Doane, Swecker & Mathis

[57] ABSTRACT

There is provided in the partition wall separating two adjacent cylinders, on one hand, a main passageway and, on the other hand, at least one conduit drilled from the upper surface of the cylinder block and putting in communication a cavity connected to a first chamber and a second chamber located on the other side of the line of cylinders. Application in particular in engines in which the distance between two adjacent cylinders is particularly small for reasons of reduced overall size.

11 Claims, 2 Drawing Sheets

Figure 4:
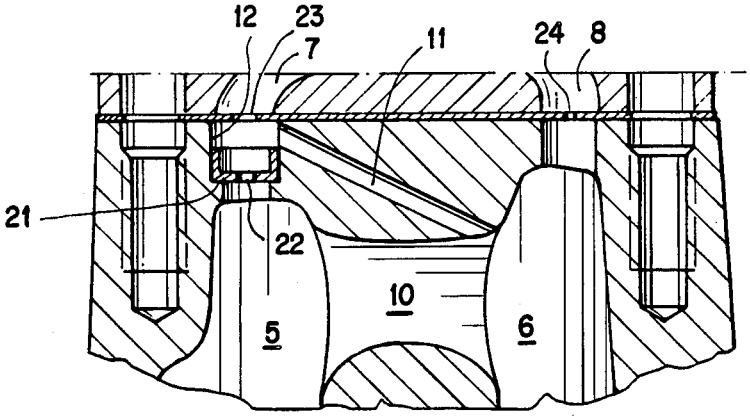

FIG. 1
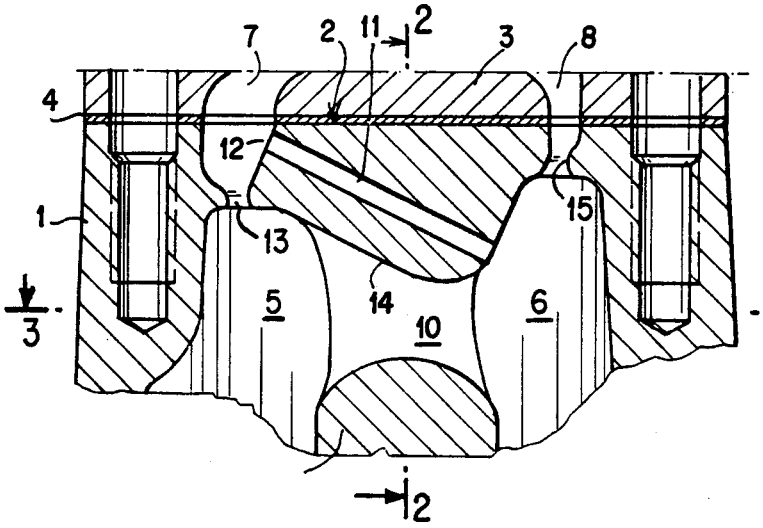
FIG. 2
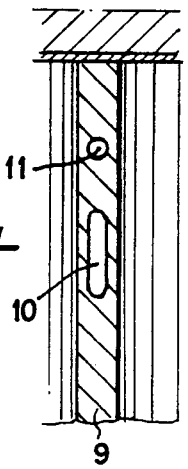
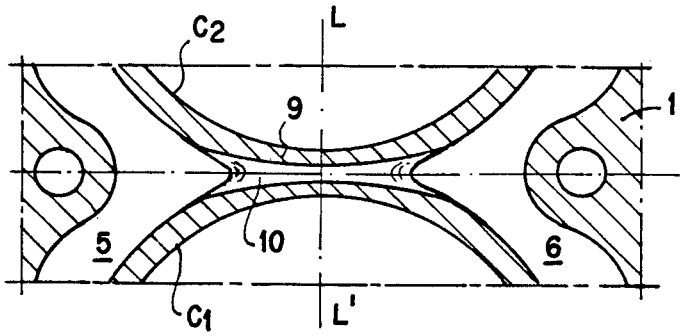
FIG. 3

INTERNAL COMBUSTION ENGINE PROVIDED WITH IMPROVED CYLINDER BLOCK COOLING MEANS

The present invention relates to internal combustion engines having a plurality of cylinders in line and in particular those engines which have a distance between the cylinders which is as short as possible in order to have the shortest possible length.

In such engines, the cylinders are provided in a cylinder block surmounted by a cylinder head, and these cylinders are cooled by a cooling liquid circuit comprising chambers disposed on each side of the line of cylinders and interconnected by passageways provided in the walls separating two adjacent cylinders.

As the cylinder block is made from cast metal, the passageway provided in the wall between two cylinders is obtained either by casting by means of a foundry core or by machining.

In the first case, neither the passageway nor the wall between two cylinders can be very narrow, on one hand bearing in mind the dimension of the bore and the shrinkage of the metal when cooling after the casting and, on the other hand, as concerns the wall, owing to risks of porosity, above all in proximity to the upper part of the cylinders where the mechanical and thermal stresses are maximum.

Consequently, the distance between two adjacent cylinders in practice cannot be less that 1 centimeter. Moreover, deformations of the wall frequently occur in the vicinity of the upper parts of the cylinders particularly when the engine is under high load, which is the case when it is supercharged.

In the second case, the passageway consists either of at least one drilling which is of necessity of small diameter and provides only a small flow of liquid and consequently an insufficient thermal exchange, or of a slot which extends in a direction perpendicular to the line of the cylinders, this slot being milled from the side of the cylinder block facing toward the cylinder head. As this slot is located in the vicinity of the upper part of the cylinders, i.e. in the hottest region which is subjected to the greatest mechanical stresses, it weakens the wall in which it is formed. The risks of deformation imply that the walls disposed on each side of the slot have a thickness of a least 4 mm, which again results in a distance between two adjacent cylinders of at least 1 cm. In order to reduce slightly this distance, it is necessary to insert a metal reinforcing member in the slot which is delicate to achieve in a reliable manner. It is found moreover that slots arranged in this manner have a tendency to become furred and are subject to deposits of particles carried along by the cooling liquid, which gradually reduces the section of the passage for this liquid.

An object of the invention is to provide an arrangement in which these various drawbacks are reduced or avoided and which ensures an effective cooling of the cylinders without weakening the partitions therebetween and without increasing the thickness of these partitions.

The invention therefore provides an internal combustion engine comprising a cast metal cylinder block defining a plurality of cylinders which are arranged in line and open onto a surface of the cylinder block adjacent to a cylinder head which is fixed to the cylinder block, two adjacent cylinders being separated by a partition wall, the cylinder block also defining a part of a cooling liquid circuit and in particular chambers located on each side of the line of cylinders and at least one cast passageway provided in said partition wall and interconnecting said chambers, wherein at least one of said chambers, disposed on one side of the line of cylinders, opens onto said surface of the cylinder block through a cavity and at least one conduit is provided in said partition wall above said passageway, said conduit extending between said cavity and the chamber located on the other side of the line of cylinders.

According to other features of the invention:

the two chambers respectively communicate with a part of the cooling liquid circuit provided in the cylinder head through narrow passageways;

a narrow passageway is located between the cavity and the adjacent chamber;

as a cylinder head gasket is interposed between the two confronting surfaces of the cylinder block and cylinder head, said gasket includes two calibrated orifices which connect the liquid circuit provided in the cylinder head, respectively to said cavity and to the chamber located on the other side of the line of cylinders.

Figure 5:
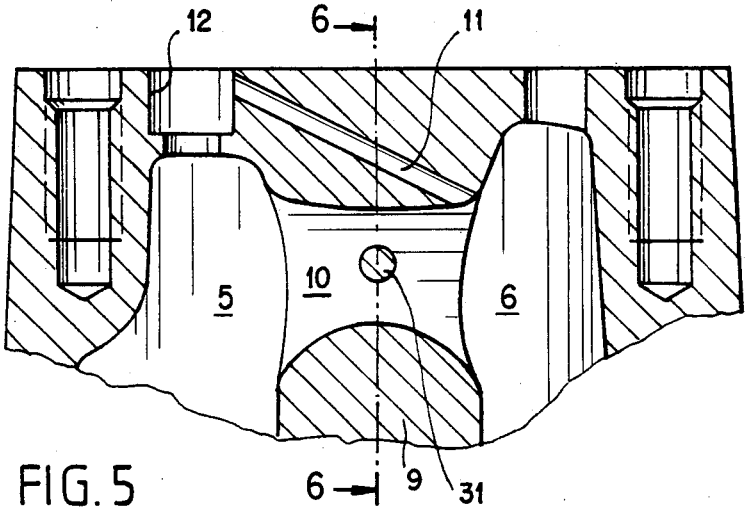
Figure 6:
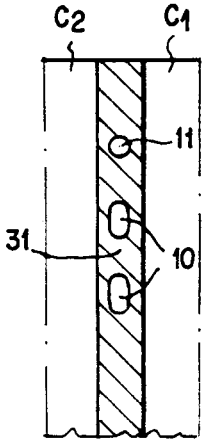

The invention will be described in more detail with reference to the accompanying drawing, which is given solely by way of example and in which:

FIG. 1 is a sectional view taken in a plane perpendicular to the line of cylinders, in the region located between two adjacent cylinders, of a first embodiment of the invention;

FIGS. 2 and 3 are respectively sectional views taken on lines 2—2 and 3—3 of FIG. 1;

FIGS. 4 and 5 are two views similar to that of FIG. 1 of two variants, and FIG. 6 is a sectional view taken on line 6—6 of FIG. 5.

FIG. 1 shows a part of a cylinder block 1 made from cast metal and defining a plurality of cylinders such as $C_1$,$C_2$ (FIG. 3), arranged in line. This line is designated by the reference L—L' and corresponds to the trace on the plane of FIG. 3 of the plane containing the axes of the various cylinders. The cylinder block has a surface 2 facing toward a cylinder head 3 fixed to the block by conventional means. A cylinder head gasket 4 is interposed in the known manner between the cylinder block and the head.

Provided on the cylinder block on each side of the line of cylinders ar chambers 5 and 6 which are part of a cooling liquid circuit. Likewise, a part 7, 8 of this cooling circuit is provided in the head.

Two adjacent cylinders are separated by a partition wall 9 which has a thickness which is as small as possible and in which is cast a passageway 10 which puts the two chambers 5 and 6 in communication with each other.

According to the invention, a conduit 11 is provided in the upper part of the partition wall 9 above the passageway 10, this drilled conduit putting the upper part of the chamber 6 in communication with a cavity 12 which opens onto the surface 2 of the cylinder block and communicates with the chamber 5, preferably through a small-section orifice 13. The oblique orientation of the conduit 11 is such that it can be machined from the upper surface of the cylinder block. Its diameter may, for example, be on the order of 4 mm. As a modification, two conduits 11 may be drilled in the partition wall 10.

Preferably, the upper edge 14 of the passageway 10 is oblique and oriented roughly in a direction parallel to the drilled conduit 11.

The second chamber 6 communicates with the part 8 of the cooling liquid circuit provided in the cylinder head through a small-section orifice 15, this orifice and the orifice 13 being cast in the embodiment shown in FIGS. 1 to 3.

In the embodiment shown in FIG. 4, the cavity 12 with which the chamber 5 communicates has a generally cylindrical shape and receives a cup 21 in which a calibrated orifice 22 is provided. The cup 21 may be fitted or screwed in the cavity 12.

Further, in this embodiment, the head gasket 4 also has two orifices 23, 24 of small section which determine the section of the passage between the parts of the cooling circuit provided in the cylinder block and in the cylinder head respectively.

In the variant shown in FIGS. 5 and 6, a cast strut 31 is provided in the median part of the passageway 10 to reinforce the partition wall 9 between the two adjacent cylinders $C_1$, $C_2$.

The arrangement just described operates in the following manner:

In rising up the cylinder block 1 toward the cylinder head 3, the cooling liquid flows, on one hand, from the chamber 5 toward the cavity 12 through the orifice 13 or 22 of small section and, on the other hand, from the chamber 6 toward the cavity 12 through the conduit 11 and toward the circuit 8 through the narrow passageway 15 or 24. Moreover, cooling liquid also flows in the passageway 10.

The various small-section passageways are so dimensioned that the pressure drops caused thereby result in an optimum division of the liquid flows in the passageway 10 and the conduit 11 and consequently a sufficient thermal exchange for correctly cooling the cylinders. Thus, according to the illustrated arrangement, the orifice 22 has a section which is smaller than that of the orifice 23 and larger than that of the orifice 24.

This arrangement provides the following advantages:

it results in an effective cooling as indicated above;

the partition wall between the cylinders may be relatively thin and has a thickness less than 1 cm, while having a good mechanical performance owing to the fact that it is solid in the vicinity of the surface 2 and the conduit 11 only has a small reducing effect on its section; now it is important to retain sufficient strength of the partition wall in proximity to the surface 2, since it is in this region that the stresses are the greatest;

the small-section passageways and the conduit 11 are unlikely to become furred or obstructed by particles, since the flow of the liquid therein is relatively high; the same is true in respect of the passageway 10, in particular owing to its remoteness from the hottest region close to the surface 2.

I claim:

1. An internal combustion engine comprising a cylinder block of cast metal defining a surface and a plurality of cylinders which are arranged in line and open onto said surface, a cylinder head fixed to the cylinder block adjacent to said surface, a partition wall separating two adjacent ones of said cylinders, the cylinder block also defining a part of a cooling liquid circuit including chambers located on each side of the line of cylinders, and at least one cast passageway provided in said partition wall and interconnecting said chambers, a cavity in the cylinder block putting at least a first of said chambers located on one side of the line of cylinders in communication with said surface of the cylinder block and at least one conduit being provided in said partition wall above said passageway, said conduit extending between said cavity and the chamber located on the opposite side of the line of cylinders to said first chamber, wherein a part of the cooling liquid circuit is provided in the cylinder head and means defining small-section passageways put the two chambers respectively in communication with said part of the cooling liquid circuit.

2. An internal combustion engine according to claim 1, wherein a small-section passageway is located between said cavity and the chamber adjacent to said cavity.

3. An internal combustion engine according to claims 1, wherein said small-section passageways are cast passageways.

4. An internal combustion engine according to claim 1, wherein the cylinder head defines a surface and a cylinder head gasket is interposed between said surface of said cylinder head and said surface of said cylinder block, said gasket comprising two calibrated orifices connecting the liquid circuit provided in the cylinder head respectively to said cavity and to said chamber disposed on the opposite side of the line of cylinders.

5. An internal combustion engine according to claim 4, wherein said orifice of said gasket adjacent to the chamber onto which said conduit opens has a section smaller than the section of the other orifice of said gasket.

6. An internal combustion engine according to claim 5, wherein a small-section passageway is located between said cavity and the chamber adjacent to said cavity, said small-section passageway located between said cavity and said chamber adjacent to said cavity has a section which is intermediate between the sections of said two calibrated orifices of said gasket.

7. An internal combustion engine according to claim 1, wherein said cavity is a cast cavity.

8. An internal combustion engine according to claim 1, wherein said cavity is a cylindrical cavity and a cup defining a small-section orifice is mounted in said cavity.

9. An internal combustion engine according to claim 1, comprising at least one strut in said passageway interconnecting the two chambers.

10. An internal combustion engine according to claim 1, wherein said conduit is a drilled conduit extending obliquely from said surface of said cylinder block.

11. An internal combustion engine according to claim 1, wherein said passageway interconnecting said chambers has an upper edge which is substantially parallel to a direction in which said conduit extends.

* * * * *